US012053070B2

(12) United States Patent
Barber et al.

(10) Patent No.: US 12,053,070 B2
(45) Date of Patent: Aug. 6, 2024

(54) CONFIGURABLE MULTI-COMPARTMENT BAG

(71) Applicant: HighRoad Adventure Gear LLC, Gilbert, AZ (US)

(72) Inventors: David M. Barber, Gilbert, AZ (US); Nicole R. Barber, Gilbert, AZ (US)

(73) Assignee: HighRoad Adventure Gear LLC, Gilbert, AZ (US)

( * ) Notice: Subject to any disclaimer, the term of this patent is extended or adjusted under 35 U.S.C. 154(b) by 180 days.

(21) Appl. No.: 17/319,975

(22) Filed: May 13, 2021

(65) Prior Publication Data

US 2021/0353024 A1 Nov. 18, 2021

Related U.S. Application Data

(60) Provisional application No. 63/024,034, filed on May 13, 2020.

(51) Int. Cl.
*A45C 13/30* (2006.01)
*A45C 3/00* (2006.01)

(52) U.S. Cl.
CPC ..... *A45C 13/30* (2013.01); *A45C 3/00* (2013.01); *A45C 2003/008* (2013.01); *A45C 2013/306* (2013.01)

(58) Field of Classification Search
CPC ..... A45C 13/30; A45C 3/00; A45C 2003/008; A45C 2013/306
USPC ..... 190/108
See application file for complete search history.

(56) References Cited

U.S. PATENT DOCUMENTS

| | | | | |
|---|---|---|---|---|
| 7,757,911 | B2 * | 7/2010 | Barker | A45F 4/02 224/625 |
| 2002/0148741 | A1 * | 10/2002 | Stobbs | A63B 71/0045 206/112 |
| 2015/0208790 | A1 * | 7/2015 | Pylkovas | A45C 13/30 224/578 |
| 2018/0242701 | A1 * | 8/2018 | Seiders | A45C 13/36 |

* cited by examiner

*Primary Examiner* — Don M Anderson
*Assistant Examiner* — Jessica Kavini Tamil

(57) ABSTRACT

A storage system includes a first container and a second container that are generally cuboid-shaped secured by their pack panels to straps enabling them to be positioned with back panels facing one another or both lying on a support surface. A portion of the straps remains detached and has a length to facilitate transitions between these positions. Fastening material may be secured to the back panels to enable them to be selectively attached to one another. Handles may be secured to the back panels, such as with the same stitching securing the straps. Drainage holes may be provided in one or more panels of the containers.

22 Claims, 4 Drawing Sheets

CONFIGURABLE MULTI-COMPARTMENT BAG

PRIORITY CLAIM

This application claims priority to U.S. Provisional Application Ser. No. 63/024,034 filed May 13, 2020.

FIELD OF THE INVENTION

This application relates to luggage and bags, particularly multi-configurable bags and luggage for transportation by automobile.

BACKGROUND OF THE INVENTION

Storage and transport bags come in many shapes and sizes. Some are uniquely configured to hold specific items. However, when storage space or room for placement of the bag may be limited or may vary depending on where the bag is placed, storage bags may fall short. For example, many people choose to travel by automobile, often for periods of days or weeks. An automobile provides the advantage of enabling a traveler to transport more items and supplies for an extended trip, as opposed to air travel. However, for extended trips, space may be scarce and a traveler may need to make use of irregularly shaped spaces. It would be an advancement in the art to provide improved storage containers for use in automobile and other types of travel or storage.

SUMMARY OF THE INVENTION

In one aspect of the invention, a storage system includes a first container and a second container, both of which are generally cuboid-shaped. One or more straps are each connected to a back panel of the first container and a back panel of the second container such that the first and second container may be positioned either with either (a) the back panel of the first container facing the back panel of the second container and (b) the back panel of the first panel facing in a same direction and being substantially coplanar with the back panel of the second panel. Each strap of the one or more straps may include a portion spanning between the first container and the second container, the portion being detached from both of the first container and the second container. The portion may have a length of 0.85*W to W, where W is a length of a smallest edge of the first container. In some embodiments, the portion has a length of 0.98*W to 0.95*W, where W is a length of a smallest edge of the first container.

In some embodiments, at least one handle secured to the back panel of at least one of the first container and the second container. In some embodiments, a first handle is secured to the back panel of the first container and a second handle is secured to the back panel of the second container. A central portion of the first handle may be secured to a central portion of the second handle.

The one or more straps may include a first strap and a second strap. The first handle may be secured to the back panel of the first container by first stitching securing the first strap to the back panel of the first container. The first handle may also be secured by second stitching also securing the second strap to the back panel of the first container. The second handle may be secured to the back panel of the second container by third stitching securing the first strap to the back panel of the second container. The second handle may also be secured by fourth stitching also securing the second strap to the back panel of the second container.

In some embodiments, first fastening material is secured to the back panel of the first container and second fastening material is secured to the back panel of the second, the second fastening material being configured to selectively engage the first fastening material.

In some embodiments, each of the first container and the second container define drain holes. Each drain hole may have a diameter of at least 0.5 inches. Each of the first container and the second container may include a top panel defining a portion of a lid.

In some embodiments, a method includes placing the first and second containers on a first support surface such that the back panel of the first container is facing the back panel of the second container and a bottom panel of the first container and a bottom panel of the second container are resting on the support surface. The method may also include placing the first and second containers on a second support surface such that the back panel of the first container and the back panel of the second container are resting on the support surface.

In another aspect of the invention, a storage system includes a first container and a second container. Each container includes a front panel, a back panel opposite the front panel, a top panel extending between the front panel and the back panel, a bottom panel extending between the front panel and the back panel and positioned opposite the top panel, a left panel extending between the front panel and the back panel and between the top panel and the bottom panel, and a right panel extending between the front panel and the back panel and between the top panel and the bottom panel and positioned opposite the left panel, the top panel forming a lid that is pivotable with respect to the back panel and selectively securable to the front panel. The storage system further includes a first strap and a second strap, each secured to both of the back panel of the first container and the back panel of the second container. A portion of each of the first strap and the second strap spans between the first container and the second container and is detached from both of the first container and the second container. The portion may have a length of 0.85*W to W, where W is a length of the top panel between the front panel and the back panel.

In some embodiments, a first handle is secured to the back panel of the first container and a second handle is secured to the back panel of the second container, a central portion of the first handle is secured to a central portion of the second handle. The first handle may be secured to the back panel of the first container by first stitching securing the first strap to the back panel of the first container and second stitching securing the second strap to the back panel of the first container. The second handle may be secured to the back panel of the second container by third stitching securing the first strap to the back panel of the second container and fourth stitching securing the second strap to the back panel of the second container.

In some embodiments, first fastening material is secured to the back panel of the first container and second fastening material secured to the back panel of the second container and configured to selectively engage the first fastening material.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
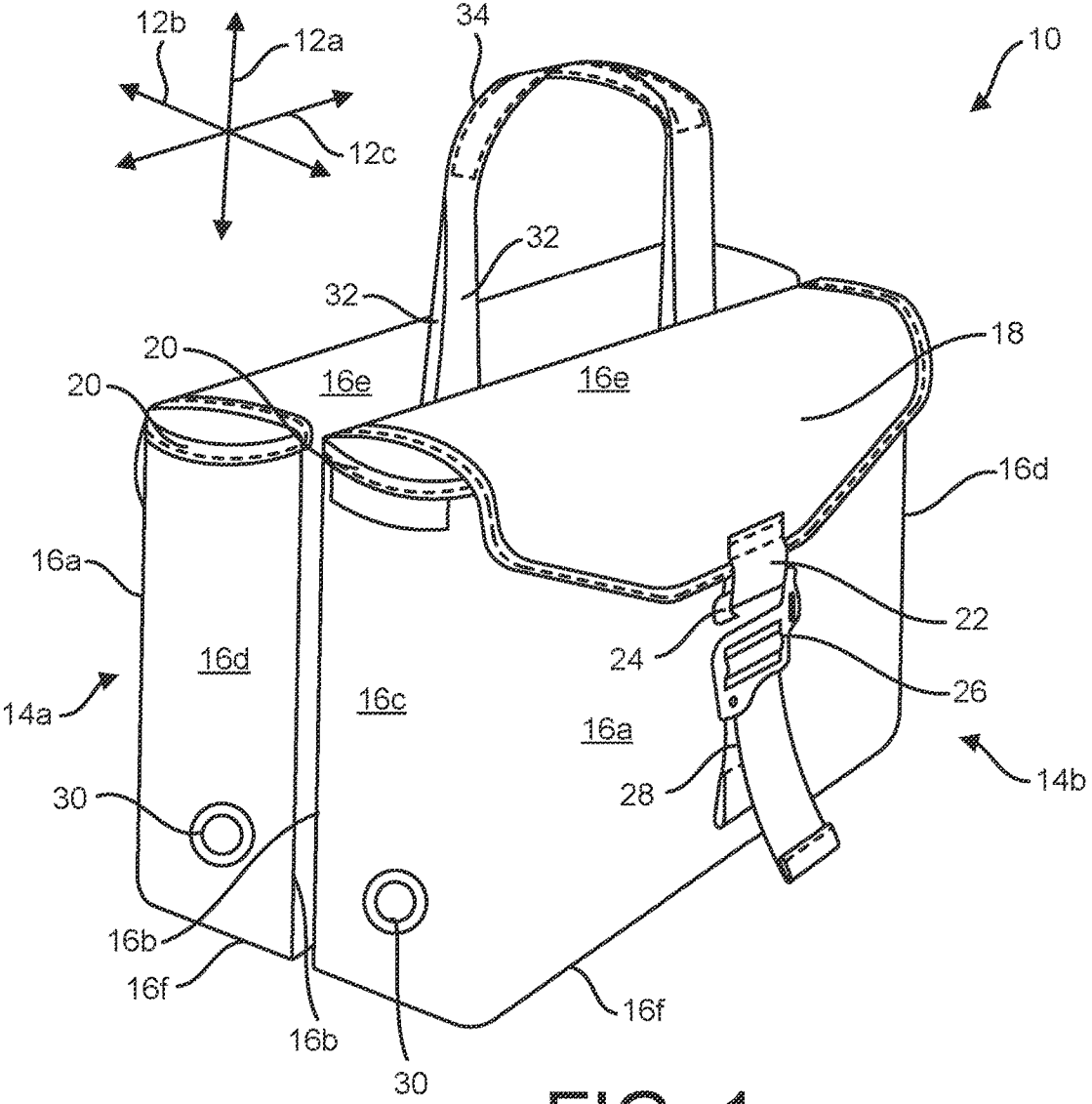
FIG. 1 is an isometric view of a multi-compartment bag in accordance with an embodiment of the present invention.
Figure 2:
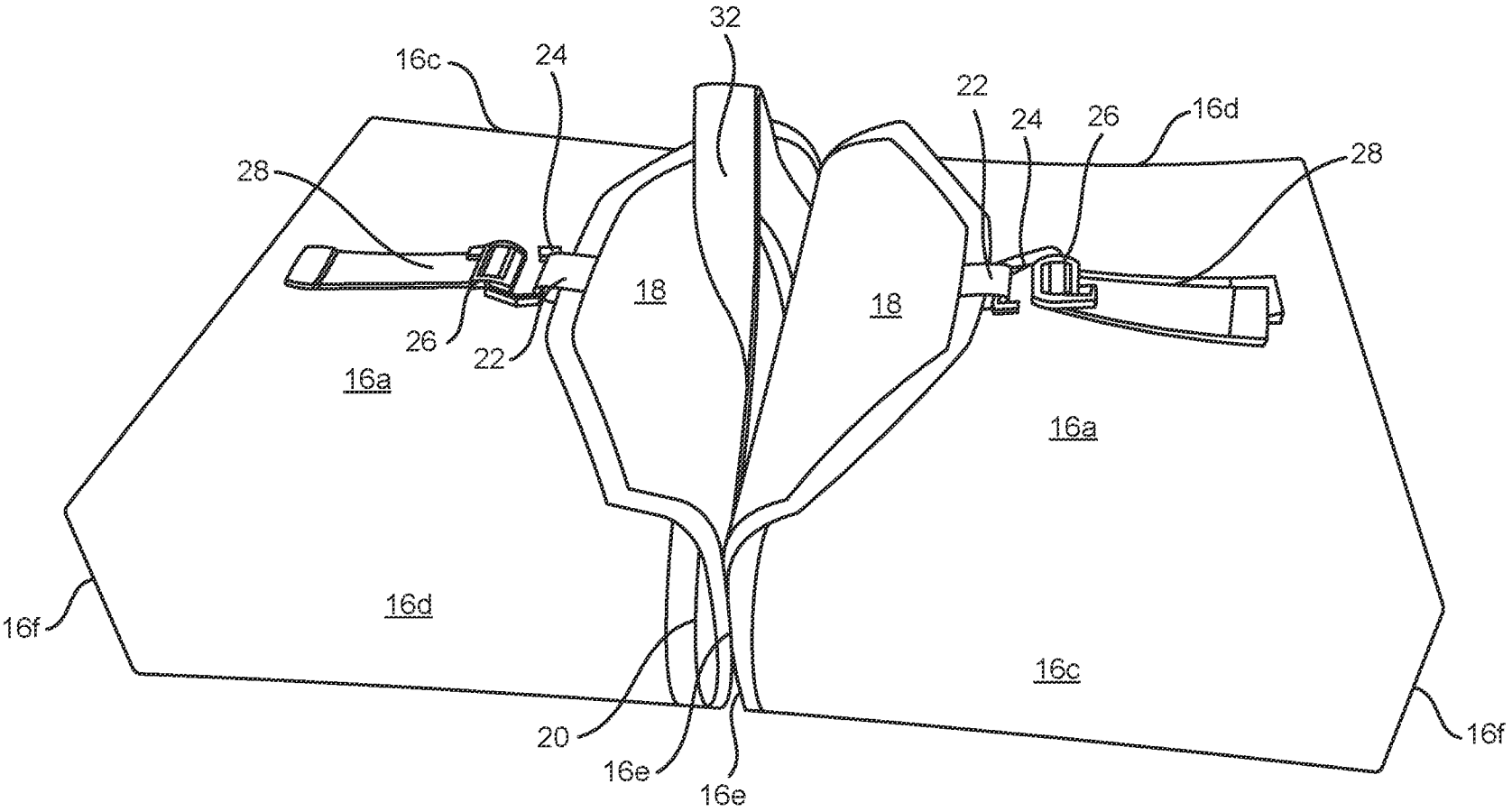
FIG. 2 is an isometric view of the multi-compartment bag in a flat configuration in accordance with an embodiment of the present invention.

Referring to FIGS. 1 and 2, a storage system 10 may be understood with respect to a vertical direction 12*a*, transverse direction 12*b*, and longitudinal direction 12*c* that are all perpendicular to one another. These directions are used herein to describe parts of the storage system 10 with respect to one another and do not need to correspond to the actual orientation of the storage system 10 in use.

The storage system 10 includes a pair of containers 14*a*, 14*b*. The containers 14*a*, 14*b* may be substantially identical (e.g., all dimensions of container 14*a* along the directions 12*a*, 12*b*, 12*c*, within 5 percent of corresponding dimensions of the container 14*b* along the directions 12*a*, 12*b*, 12*c*). The containers 14*a*, 14*b* may be in a mirrored configuration about a vertical-transverse plane that is parallel to the vertical direction 12*a* and transverse direction 12*b*.

Each container 14*a*, 14*b* may have a generally cuboid shape, although any block shape, whether parallelepiped or not may also be used. "Generally cuboid" may be understood to be such that a cuboid shape may be defined such that every point on the exterior of the container 14*a*, 14*b* is offset from the cuboid shape by no more than 0.06*L, where L is the length of the longest edge of the cuboid shape. The containers 14*a*, 14*b* may be made of a stiff fabric such that the shape of the containers 14*a*, 14*b* may bulge outwardly or inwardly from a cuboid shape with edges parallel to the directions 12*a*, 12*b*, 12*c*. For example, each container 14*a*, 14*b* may include a front panel 16*a* and a back panel 16*b* that are both parallel to the vertical-transverse plane. Each container 14*a*, 14*b* may include a left panel 16*c* and a right panel 16*d* that are parallel to a vertical-longitudinal plane that is parallel to the vertical direction 12*a* and the longitudinal direction 12*c*. Each container 14*a*, 14*b* may include a top panel 16*e* and a bottom panel 16*f* that are parallel to a transverse-longitudinal plane that is parallel to the transverse direction 12*b* and the longitudinal direction 12*c*.

Due to flexibility of the material forming the panels 16*a*-16*f*, "parallel" to a plane shall be understood to mean a rectangle area parallel to the plane may be defined such that all of the panel 16*a*-16*f* is within a threshold distance of the rectangular area. The threshold distance may be defined as 5 percent of the longest dimension of the panel 16*a*-16*f* along one of the directions 12*a*, 12*b*, 12*c*. Due to flexibility of the material forming the panels 16*a*-16*f*, corners between panels may be somewhat rounded.

The top panel 16*e* may be secured to the back panel 16*b* but may remain unsecured to the front, left, right, and front panels 16*a*, 16*c*, 16*d* such that the top panel 16*e* forms part of a lid 18 that may be opened to access the volume defined by the panels 16*a*-16*f* A portion of the lid 18 may be extend over the front panel 16*a*. An opening 20 covered by the lid 18 may be formed by upper edges of the left and right panels 16*c*, 16*d* and an upper edge of the front panel 16*a*.

The lid 18 may secure to the front panel 16*a* by any closure means known in the art. In the illustrated embodiment, a loop 22 secures to the lid 18 and selectively engages a hook 24 secured to the front panel 16*a*. For example, the hook 24 may include a buckle 26, such as two-bar, three-bar, or other type of buckle. The buckle 26 may engage a strap 28 secured to the front panel 16*a*. In use, a user may close the lid 18 over the opening 20, pass the hook 24 through the loop 22, and then tension the strap 28. This type of closure may be advantageous for use in dirty, wet, or snowy environments as it is easily securable when wet or dirty as well as with gloved hands.

One or more of the panels 16*a*-16*f* may include openings 30 for draining and ventilation. In the illustrated embodiments, the openings 30 are formed by grommets secured through the left and right panels 16*c*, 16*d*, The openings 30 may have diameters of from 0.5 to 1.5 inches. In the illustrated embodiment, the openings 30 are positioned closer to the bottom panel 16*f* than to the top panel 16*e*, such as within 0.5 and 2 inches from the bottom panel 16*f*. The openings 30 may be substantially (e.g., within 0.5 inches) centered between the front and back panels 16*a*, 16*b*, though other configurations may also be used. The openings allow water to drain, for example, if the item carried is wet or snowy. The ventilation provided then allows the item to dry.

A carrying strap 32 may be secured to the back panel 16*b* of each container 14*a*, 14*b*. The carrying strap 32 of the container 14*a* may be secured to the carrying strap 32 of the container 14*b*. For example, a center portion of each strap 32 may be secured to the other by stitching 34.

The containers 14*a*, 14*b* may be stowed in the configuration of FIG. 1. Alternatively, as shown in FIG. 2, the containers 14*a*, 14*b* may be laid such that they extend outwardly from one another, with top panels 16*e* facing one another and the back panels 16*b* being substantially coplanar, e.g. within one inch of a common plane. In the configuration of both FIG. 1 and FIG. 2 the back panels 16*b* of both containers 14*a*, 14*b* are substantially parallel. In the configuration of FIG. 1, the back panels 16*b* are substantially parallel and face one another. "Substantially parallel" may be understood to be such that each point on the back panels 16*b* is within 0.5 inches of a common plane. In the configuration of FIG. 2, the back panels 16*b* face in a same direction and are substantially coplanar. "Substantially coplanar" may be understood to be such that each point on the back panels 16*b* is within 0.5 inches of a common plane.

The panels 16*a*-16*f* may be made of vinyl coated polyester, marine vinyl, or urethane-backed Cordura, among other fabrics and materials. The straps 32 and loop 22 may be made of polyester or nylon webbing, although other materials may also be employed. The webbing is preferably one inch wide but may vary for larger versions.

Figure 3:
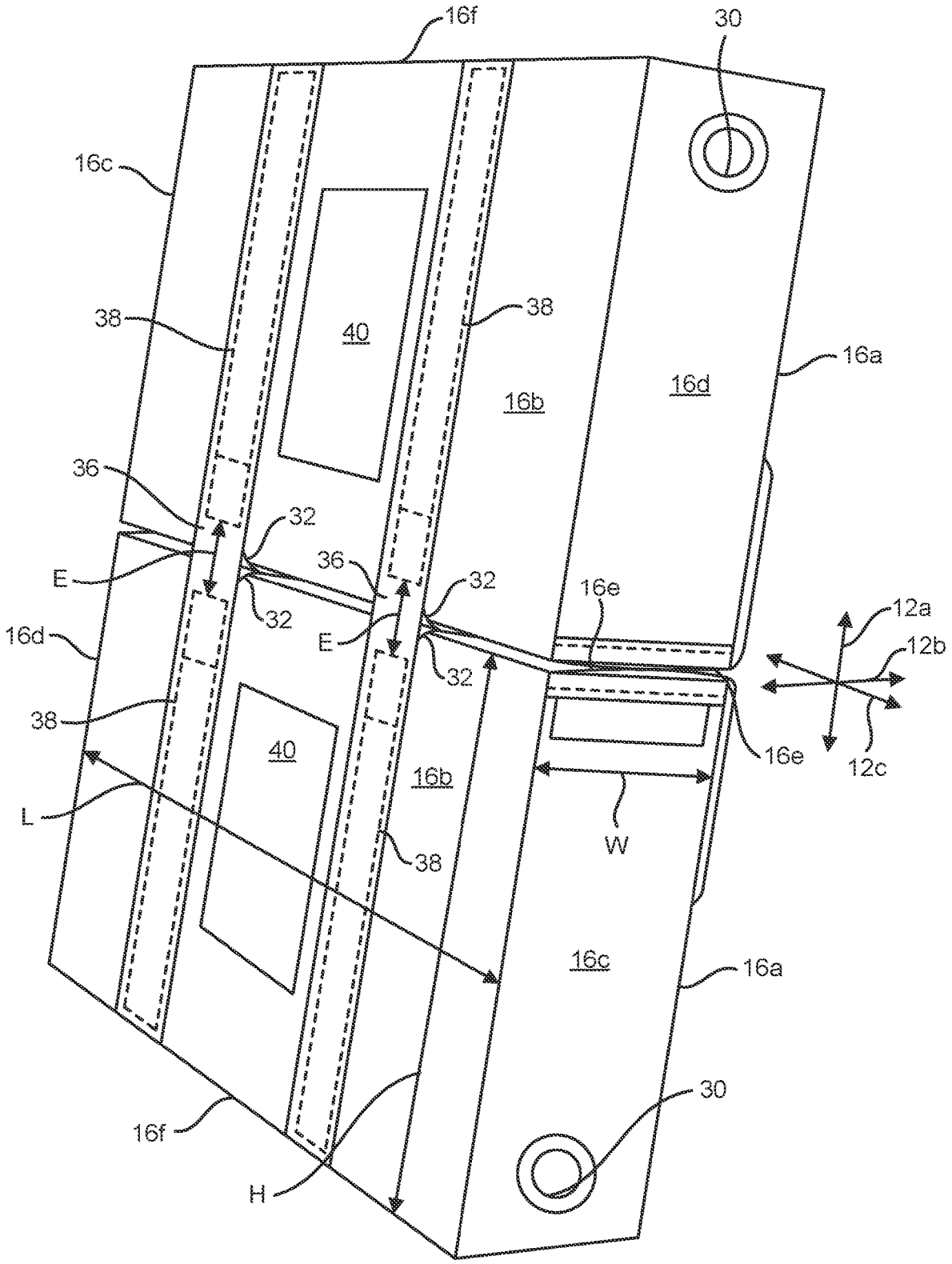
FIG. 3 is a rear isometric view of the multi-compartment bag in the flat configuration in accordance with an embodiment of the present invention.

Referring to FIG. 3, the containers 14*a*, 14*b* may be connected to one another by one or more straps 36. Each strap 36 may be secured to the back panel 16*b* of each container 14*a*, 14*b*. In some embodiments, stitching 38 secures each strap 36 to the back panel 16*b*. The stitching 38 may also secure one end of the carrying strap 32 to the back panel 16*b*. In the illustrated embodiment, each end of each carrying strap 32 is captured between one of the straps 36 and the back panel 16*b*. In the illustrated embodiment, the straps 36 (e.g., the long dimension thereof) are oriented parallel to the vertical direction 12*a*. The straps 36 may be made of any of the materials listed above for forming the straps 32.

The containers 14*a*, 14*b* may be arranged as shown in FIG. 1 or FIG. 2. The extent E of the strap 36 that remains detached from the containers 14*a*, 14*b* may be selected to facilitate pivoting between the orientations of FIGS. 1 and 2 and to maintain the containers 14*a*, 14*b* upright when resting in the orientation of FIG. 1 or when carried by the carrying strap 32. For example, for a width W of the top panel 16*e* in the transverse direction 12*b*, E may be a value from 0.35*W to 0.55 W, preferably from 0.4 W to 0.5 W. Experiments conducted by the inventor have found that a value of E of 1.5 inches provides an appropriate balance between permitting pivoting while still maintaining the containers 14*a*, 14*b* upright for a width W of 3.25 inches.

Other dimensions of the containers 14*a*, 14*b* may include a height H parallel to the vertical direction 12*a* and a length L parallel to the longitudinal direction 12*c*. As is apparent, the containers 14*a*, 14*b* may have a flat shape with a width W that is less than 40 percent of one or both of H and W. H and L may be equal or unequal. For example, L may be slightly (e.g., 5 to 10 percent) greater than H. In one example embodiment, W is 3.25 inches, H is 9.5, and L is 12 inches.

In some embodiments, the back panels 16*b* of the containers 14*a*, 14*b* have fastener portions 40 secured thereto. For example, hook-and-loop fastener portions, such as VELCRO, 3M DUAL LOCK, snap fasteners, or other type of fasteners. There may be hook material 40 secured to container 14*a* and loop material 40 secured to the container 14*b*. When in the configuration of FIG. 1, the fastening material 40 of the containers 14*a*, 14*b* may be engaged with one another to prevent separation of the containers 14*a*, 14*b*.

Figure 4:
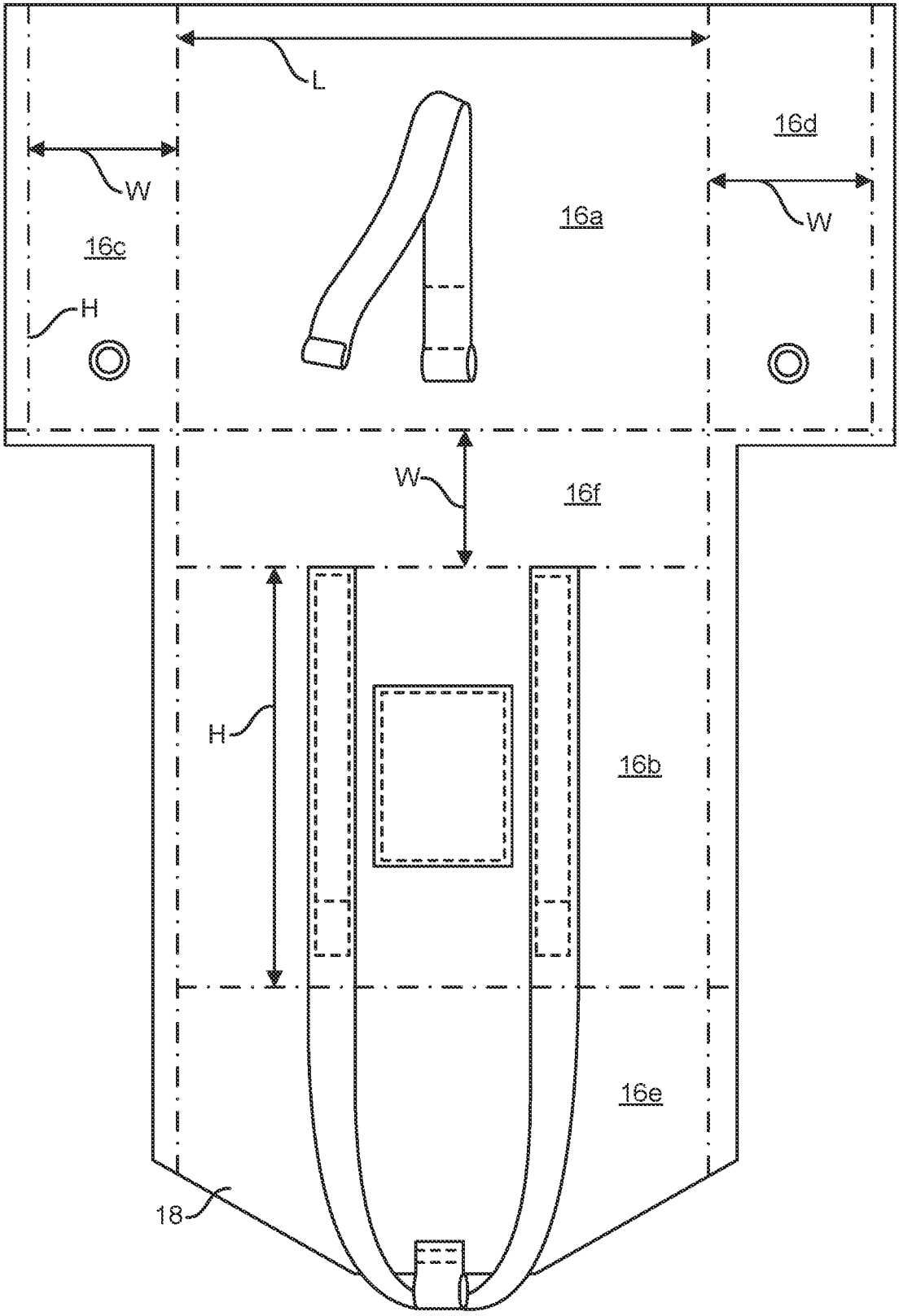
FIG. 4 is a top view of a sheet of material suitable for making a compartment of the multi-compartment bag in accordance with an embodiment of the present invention.

Referring to FIG. 4, each container 14*a*, 14*b* may be formed of a single sheet of material as shown. As shown, each of the panels 16*a*-16*f* may be formed by part of the sheet of material and have dimensions W, H, and L as illustrated with excess material for stitching the panels 16*a*-16*f* together. The dash-dot-dash lines in FIG. 4 illustrate the edges between the panels 16*a*-16*f*.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A storage system comprising:

a first container;

a second container;

one or more straps, each strap of the one or more straps connected to a back panel of the first container and a back panel of the second container such that the first and second containers may be positioned with the back panel of the first container facing the back panel of the second container; and wherein the containers can be placed such that the back panel of the first container is in the same direction and substantially coplanar with the back panel of the second container; and a first handle secured to the back panel of the first container and a second handle secured to the back panel of the second container, a central portion of the first handle being secured to a central portion of the second handle;

wherein:

the one or more straps comprise a first strap and a second strap;

the first handle is secured to the back panel of the first container by first stitching securing the first strap to the back panel of the first container and second stitching securing the second strap to the back panel of the first container; and the second handle is secured to the back panel of the second container by third stitching securing the first strap to the back panel of the second container and fourth stitching securing the second strap to the back panel of the second container.

2. The storage system of claim 1, wherein each strap of the one or more straps includes a spanning portion spanning between the first container and the second container, the spanning portion being detached from both of the first container and the second container.

3. The storage system of claim 2, wherein the first container and the second container are generally cuboid-shaped and the spanning portion has a length of 0.35*W to 0.55 W, where W is a length of a smallest edge of the first container.

4. The storage system of claim 2, wherein the spanning portion has a length of 0.4*W to 0.5*W, where W is a length of a smallest edge of the first container.

5. The storage system of claim 1, further comprising at least one handle secured to the back panel of at least one of the first container and the second container.

6. The storage system of claim 1, further comprising a first handle secured to the back panel of the first container and a second handle secured to the back panel of the second container.

7. The storage system of claim 6, wherein a central portion of the first handle is secured to a central portion of the second handle.

8. The storage system of claim 1, further comprising:

first fastening material secured to the back panel of the first container; and second fastening material secured to the back panel of the second container and configured to selectively engage the first fastening material.

9. The storage system of claim 1, wherein each of the first container and the second container define drain holes.

10. The storage system of claim 1, wherein each of the first container and the second container is generally cuboid-shaped.

11. The storage system of claim 1, wherein each of the first container and the second container each includes a top panel, the top panel defining a portion of a lid.

12. A method comprising:

providing a storage system including:

a first container;

a second container; and one or more straps, each strap of the one or more straps connected to a back panel of the first container and a back panel of the second container;

placing the first and second containers on a first support surface such that the back panel of the first container is facing the back panel of the second container and a bottom panel of the first container and a bottom panel of the second container are resting on the support surface; and placing the first and second containers on a second support surface such that the back panel of the first container and the back panel of the second container are resting on the second support surface;

and wherein the containers can be placed such that the back panel of the first container is in the same direction and substantially coplanar with the back panel of the second container; and wherein the first container and the second container are cuboid-shaped and each strap of the one or more straps includes a portion spanning between the first container and the second container, the portion being detached from both of the first container and the second container, the portion having a length of 0.4*W to 0.5 W, where W is a length of a smallest edge of the first container.

13. The method of claim 12, wherein:

further comprising a first handle secured to the back panel of the first container and a second handle secured to the back panel of the second container, a central portion of the first handle is secured to a central portion of the second handle; and the method further comprising, carrying the first container and the second container using the first handle and the second handle.

14. The method of claim 13, wherein:

the one or more straps comprise a first strap and a second strap;

the first handle is secured to the back panel of the first container by first stitching securing the first strap to the back panel of the first container and second stitching securing the second strap to the back panel of the first container; and the second handle is secured to the back panel of the second container by third stitching securing the first strap to the back panel of the second container and fourth stitching securing the second strap to the back panel of the second container.

15. The method of claim 12, wherein:

the storage system further comprises:

first fastening material secured to the back panel of the first container; and second fastening material secured to the back panel of the second container and configured to selectively engage the first fastening material; and the method further comprises securing the first fastening material to the second fastening material.

16. A storage system comprising:

a first container and a second container, each including a front panel, a back panel opposite the front panel, a top panel extending between the front panel and the back panel, a bottom panel extending between the front panel and the back panel and positioned opposite the top panel, a left panel extending between the front panel and the back panel and between the top panel and the bottom panel, and a right panel extending between the front panel and the back panel and between the top panel and the bottom panel and positioned opposite the left panel, the top panel forming a lid that is pivotable with respect to the back panel and selectively securable to the front panel; and a first strap and a second strap, each secured to both of the back panel of the first container and the back panel of the second container, wherein a portion of each of the first strap and the second strap spans between the first container and the second container and is detached from both of the first container and the second container, the portion having a length of 0.4*W to 0.5 W, where W is a length of the top panel between the front panel and the back panel.

17. The storage system of claim 16, further comprising:

a first handle secured to the back panel of the first container and a second handle secured to the back panel of the second container, a central portion of the first handle is secured to a central portion of the second handle;

wherein:

the first handle is secured to the back panel of the first container by first stitching securing the first strap to the back panel of the first container and second stitching securing the second strap to the back panel of the first container, the first handle being captured between the first strap and the back panel of the first container and between the first strap and the back panel of the second container; and the second handle is secured to the back panel of the second container by third stitching securing the first strap to the back panel of the second container and fourth stitching securing the second strap to the back panel of the second container, the second handle being captured between the second strap and the back panel of the first container and between the second strap and the back panel of the second container.

18. The storage system of claim 16, further comprising:

first fastening material secured to the back panel of the first container; and second fastening material secured to the back panel of the second container and configured to selectively engage the first fastening material.

19. A storage system comprising:

a first container and a second container, each including a front panel, a back panel opposite the front panel, a bottom panel extending between the front panel and the back panel; and a first strap secured to both of the back panel of the first container and the back panel of the second container, wherein a portion of the first strap spans between the first container and the second container to function as a pivot between the first container and the second container, the portion having a length equal to or less than .55W, where W is a width of the bottom panel between the front panel and the back panel, the length being shorter than the width to aid in stability of the first container and the second container when positioned adjacent one another resting on respective bottom panels and to aid in stability and alignment when the first and second containers are laid adjacent one another on their respective back panels.

20. The storage system of claim 19, further comprising a second strap secured to both of the back panel of the first container and the back panel of the second container, wherein a portion of the second strap spans between the first container and the second container, the portion having a length equal to or less than .55W, where W is a width of the bottom panel between the front panel and the back panel.

21. The storage system of claim 20, wherein the length of the portion of the first strap that spans between the first and second containers is substantially the same length as the portion of the second strap that spans between the first and second containers.

22. The storage system of claim 19, further comprising a first handle secured between the first strap and the second strap on the back panel of the first container and a second handle secured between the first strap and the second strap on the back panel of the second container, the first handle and the second handle being fixed together such that the two bags are inseparable, the handle fixation also facilitating lifting the first container and the second container together from either a position of lying either on their back panels or from a position of lying on their bottom panels.

* * * * *